US008556780B2

(12) United States Patent
Chen

(10) Patent No.: US 8,556,780 B2
(45) Date of Patent: Oct. 15, 2013

(54) MULTI-FUNCTIONAL LINKED FITNESS EQUIPMENT

(76) Inventor: Yi-Tzu Chen, Bade (TW)

( * ) Notice: Subject to any disclaimer, the term of this patent is extended or adjusted under 35 U.S.C. 154(b) by 388 days.

(21) Appl. No.: 13/078,594

(22) Filed: Apr. 1, 2011

(65) Prior Publication Data

US 2012/0252642 A1 Oct. 4, 2012

(51) Int. Cl.
*A63B 21/00* (2006.01)

(52) U.S. Cl.
USPC ..... 482/72; 482/96; 482/140

(58) Field of Classification Search
USPC ..... 482/72, 96, 140
See application file for complete search history.

(56) References Cited

U.S. PATENT DOCUMENTS 5,695,435 A * 12/1997 Dalebout et al. ..... 482/96
5,827,158 A * 10/1998 Drecksel ..... 482/96
6,135,930 A * 10/2000 Kuo ..... 482/72
6,752,748 B1 * 6/2004 Scotti ..... 482/140
7,229,389 B2 * 6/2007 Hong ..... 482/96
7,500,938 B2 * 3/2009 Fan ..... 482/72

* cited by examiner

*Primary Examiner* — Jerome W Donnelly
(74) *Attorney, Agent, or Firm* — Muncy, Geissler, Olds & Lowe, PLLC

(57) ABSTRACT

A multifunctional linked fitness equipment has an elongated bottom, a seat stand, a front support frame seat pivotally mounted on a front end of the elongated bottom, a rear support frame seat pivotally mounted on a rear end of the seat stand, a link pivotally mounted between the front support frame seat and the rear support frame seat, a front support frame pivotally mounted on the elongated bottom and the front support frame seat, a rear support frame pivotally mounted on the elongated bottom and the rear support frame seat, and at least one resilient member mounted between the rear support frame seat and the elongated bottom. By combining or detaching the front support frame, the rear support frame or the seat stand with or from positioning pins, the fitness equipment can be utilized to selectively exercise the abdominal muscles and the legs based on the users' demand.

5 Claims, 8 Drawing Sheets

MULTI-FUNCTIONAL LINKED FITNESS EQUIPMENT

BACKGROUND OF THE INVENTION

1. Field of the Invention

The present invention relates to a linked fitness equipment, and more particularly to a multi-functional linked fitness equipment capable of selectively exercising abdominal muscles.

2. Description of the Related Art

Sit-up is a strength training exercise that targets at building abdominal muscles, and can be performed in a small space no matter where you are by lying directly on the floor or using a mat. However, many researches point out that despite a standard site-up movement, an arched back caused by the stretched gluteal muscles and the abdominal muscles may injure spine and lumbar intervertebral discs.

Although many fitness equipments for exercising abdominal muscles are available in the market to avoid or reduce the exercise injury when the equipment is used to exercise abdominal muscles, most of such fitness equipment is unifunctional and fails to exercise other parts of muscles. Therefore, a variety of fitness equipment is needed to train the muscles of other parts of the body, making fitness not only costly but also space demanding in terms of accommodating various fitness equipments.

SUMMARY OF THE INVENTION

An objective of the present invention is to provide a multifunctional linked fitness equipment capable of selectively exercising abdominal muscles without causing exercise injury.

To achieve the foregoing objective, the multifunctional linked fitness equipment has a base, a link, at least one resilient member, a seat, a front support frame and a rear support frame.

The base has an elongated bottom, a seat stand, a front support frame seat and a rear support frame seat.

The elongated bottom is adapted to rest on a floor and has a front end and a rear end. The seat stand is mounted on the elongated bottom, and has a front, a rear, a seat locking hole, two back alignment plates and two back positioning holes. The seat locking hole is formed through the seat stand. The back alignment plates are mounted on the rear of the seat stand. The back positioning holes are respectively formed through the back alignment plates. The front support frame seat is pivotally mounted on the front of the seat stand and has two pivot wings, a bottom end and a positioning hole formed through the front support frame. One end of each pivot wing is pivotally mounted on the front end of the elongated bottom. The rear support frame seat is pivotally mounted on the rear of the seat stand, and has a positioning hole formed through the rear support frame seat and a bottom end.

The link has a front end pivotally mounted between the free ends of the two pivot wings and a rear end pivotally mounted on the rear of the seat stand.

One end of each one of the at least one resilient member is securely connected with the rear end of the elongated bottom, and the other end is pivotally mounted on the rear end of the link.

The seat is mounted on the seat stand and has a seat positioning hole and a seat positioning pin. The seat positioning hole is formed in a side of the seat facing the seat stand and corresponding to the seat locking hole on the seat stand. The seat positioning pin is detachably mounted through the seat positioning hole and the seat locking hole.

The front support frame is pivotally mounted on the front support frame seat and has a post positioning hole and a front positioning pin. The post positioning hole is formed through the front support frame and corresponds to the positioning holes of the front support frame seat. The front positioning pin is detachably mounted through the positioning hole of the front support frame and the positioning hole of the front support frame seat.

The rear support frame is pivotally mounted on the rear support seat of the seat stand, and has a bottom, an alignment sector, a positioning hole and a rear positioning pin. The alignment sector is formed on the bottom of the rear support frame and has multiple alignment holes formed through the alignment sector and spaced apart from each other. The positioning hole is formed through the rear support frame and corresponds to the positioning hole of the rear support frame seat. The rear positioning pin is detachably mounted through the positioning hole of the rear support frame, the positioning hole of the rear support frame seat, and one of the alignment holes of the alignment sector.

The front positioning pin and the rear positioning pin are employed to combine or detach the front support frame or the rear support frame so that the a combination of the front support frame and the rear support frame can be driven to exercise the upper abdominal muscles or the lower abdominal muscles or both. The seat positioning pin is used to fasten the seat and the seat stand so that the exercise injury does not occur when a user exercises the abdomen and sways the seat.

Other objectives, advantages and novel features of the invention will become more apparent from the following detailed description when taken in conjunction with the accompanying drawings.

DETAILED DESCRIPTION OF THE INVENTION

Figure 1:
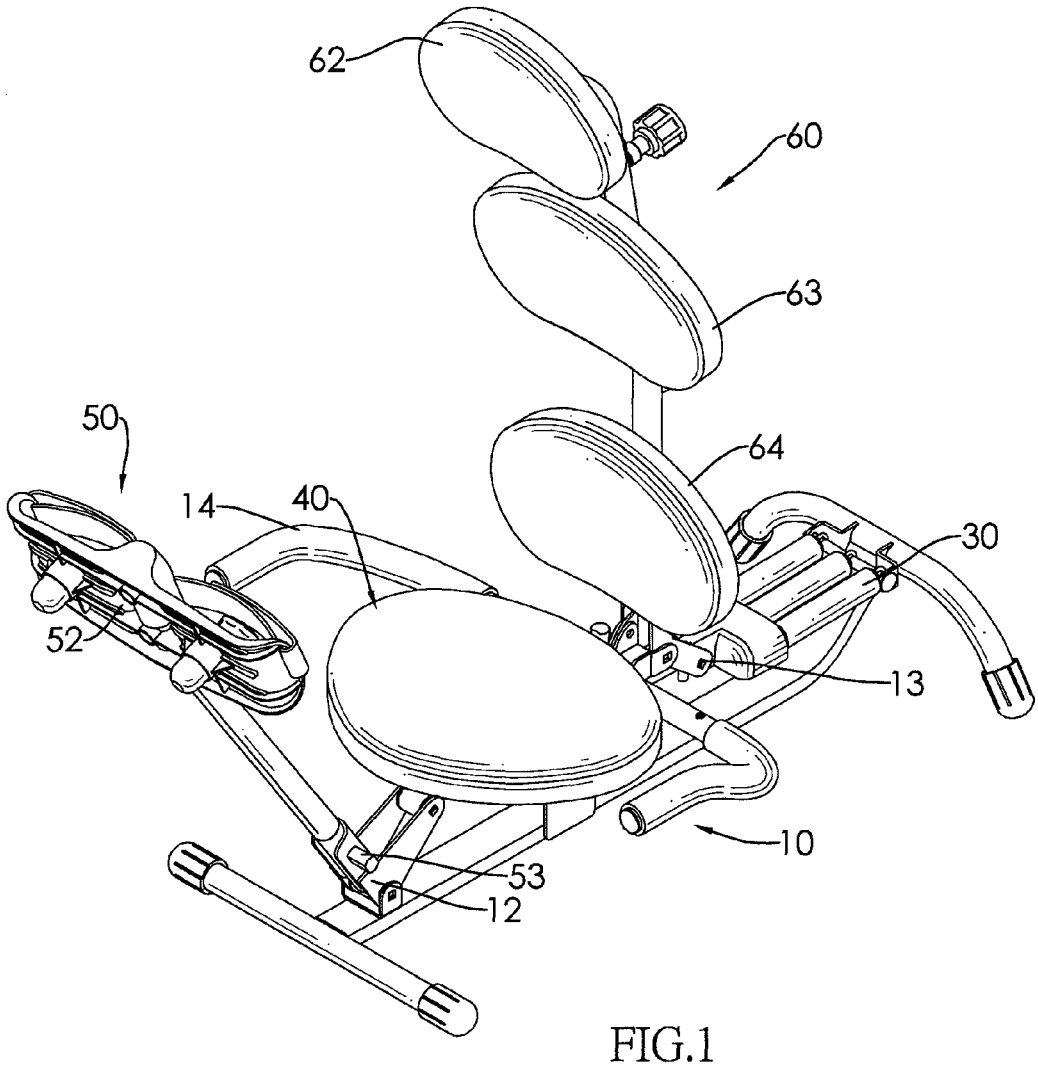
FIG. 1 is a perspective view of a multi-functional linked fitness equipment in accordance with the present invention.
Figure 2:
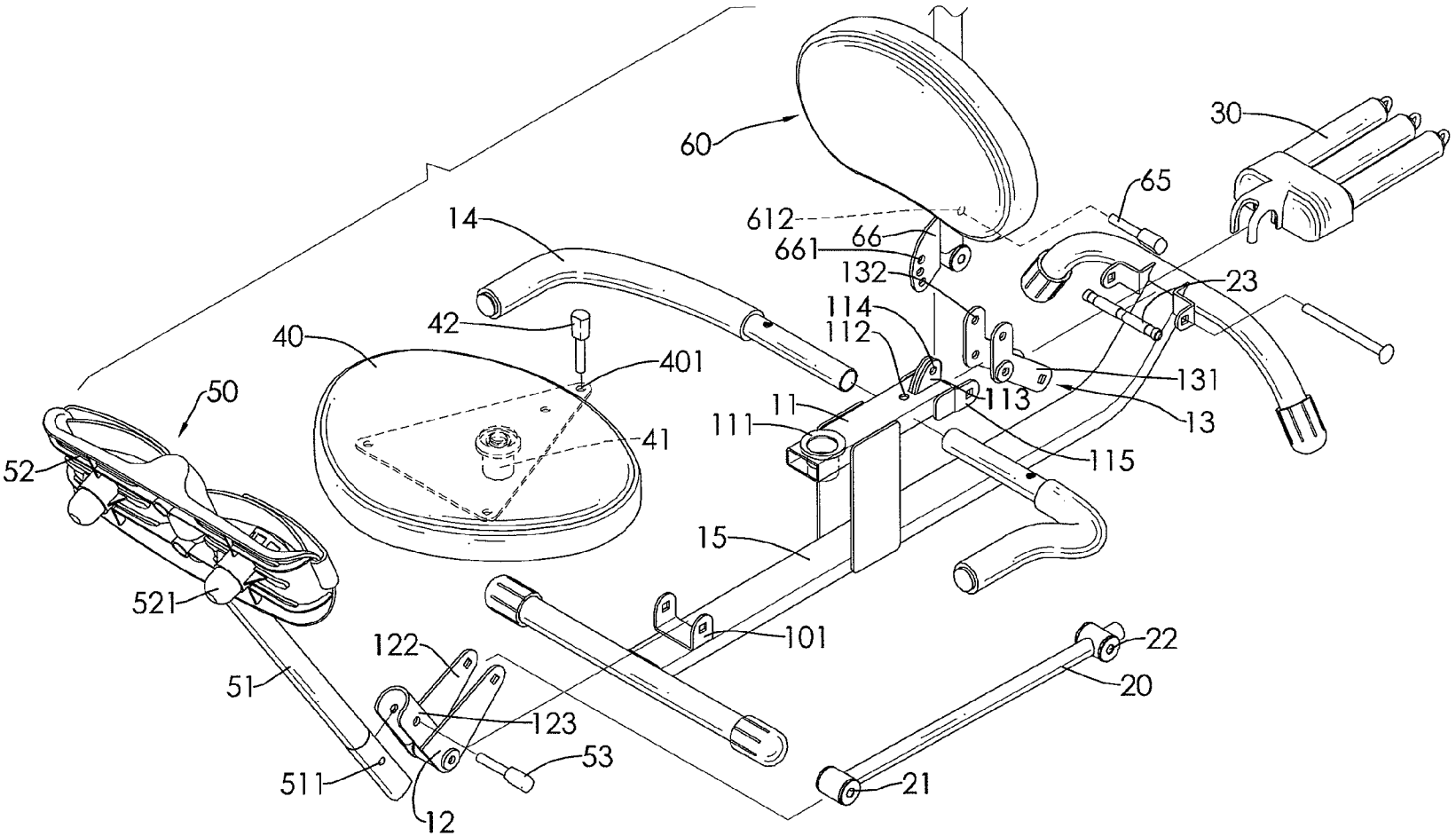
FIG. 2 is an exploded perspective view of the multi-functional linked fitness equipment in FIG. 1.
Figure 3:
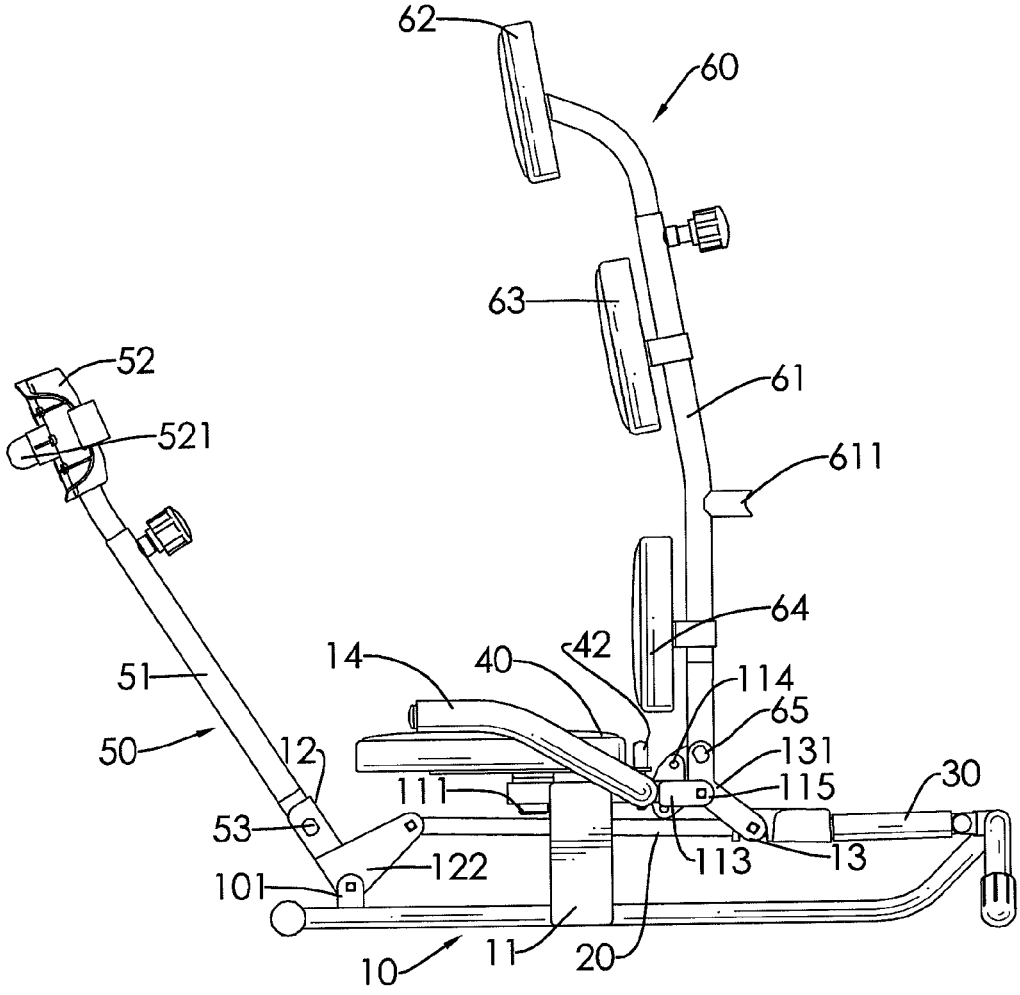
FIG. 3 is a side view of the multi-functional linked fitness equipment in FIG. 1.

With reference to FIGS. 1 to 3, a multi-functional linked fitness equipment in accordance with the present invention has a base 10, a link 20, at least one resilient member 30, a seat 40, a front support frame 50 and a rear support frame 60.

The base 10 has an elongated bottom, a seat stand 11, a front pivot bracket 101, a front support frame seat 12, a rear pivot bracket 115, a rear support frame seat 13 and two handles 14.

The elongated bottom is rested on a floor. The seat stand 11 is mounted on the elongated bottom, is T-shaped, and has a horizontal segment, a rotary joint 111, a seat locking hole 112, two back alignment plates 113 and two back positioning holes 114. The horizontal segment has a rectangular section. The rotary joint 111 is mounted in a front end of the horizontal segment of the seat stand 11 and has a bearing mounted in the rotary joint 111. The seat locking hole 112 is vertically formed through the top and the bottom near a rear end of the horizontal segment of the seat stand 11. The back alignment plates 113 are mounted on the top at the rear end of the horizontal segment of the seat stand 11 and has a gap defined between the back alignment plates 113. The two back positioning holes 114 are respectively formed through the two back alignment plates 113 and correspond to and align with each other.

The front pivot bracket 101 is mounted on and protrudes upwardly from a top of a front end of the elongated bottom and is U-shaped.

The front support frame seat 12 has a tubular post holder 123, two footrest positioning holes 121 and two pivot wings 122. The post holder 123 is curved in cross section and has an opening longitudinally formed through a front portion of a periphery of the arced tube 123. The two footrest positioning holes 121 are oppositely formed through a top end of the periphery of the post holder 123. One end of each pivot wing 122 is pivotally mounted on a bottom end of the periphery of the post holder 123 and on the front pivot bracket 101. The two pivot wings 122 are parallel with each other and have a gap defined between the pivot wings 122.

The rear pivot bracket 115 has two plates mounted on and protruding rearwardly from two sides of the rear end of the horizontal segment of the seat stand 11.

The rear support frame seat 13 has two pivot elbows 131. Each pivot elbow 131 has two segments and a rear frame positioning hole 132. The segments are obliquely and integrally formed together. A junction of the two segments of each pivot elbow 131 is pivotally mounted on an inner side of one of the plates of the rear pivot bracket 115. The rear frame positioning hole 132 is formed through the top of the pivot elbow 131.

One end of each handle 14 is securely mounted on one side of the horizontal segment of the seat stand 11.

The link 20 has a front pivot portion 21 and a rear pivot portion 22. The front pivot portion 21 is formed on a front end of the link 20, and is pivotally mounted between the free ends of the two pivot wings 122. The rear pivot portion 22 is pivotally mounted between bottom ends of the two pivot elbows 131 of the rear support frame seat 13 by a pivot pin 23.

Each one of the at least one resilient member 30 may be a spring. One end of each one of the at least one resilient member 30 is securely connected with a rear end of the elongated bottom of the base 10, and the other end is pivotally connected to the link 20 and is mounted between the pivot elbows 131 of the rear support frame seat 13 and around the pivot pin 23. In the present embodiment, three resilient members 30 are mounted between the base 10 and the link 20.

The seat 40 is mounted on the seat stand 11, and has a positioning plate and a rotation shaft 41. The positioning plate is mounted on a bottom of the seat 40 and protrudes beyond the seat 40. The rotation shaft 41 is formed on and protrudes downwardly from the bottom of the seat 40, and is mounted through the bearing of the rotary joint 111 so that the seat 40 can be rotatable on the seat stand 11. The positioning plate has a seat positioning hole 401 formed through a portion of the positioning plate, separated from the rotation shaft 41 and corresponding to the seat locking hole 112 on the seat stand 11. A seat positioning pin 42 is detachably mounted through the seat positioning hole 401 and the seat locking hole 112 so that the seat 40 can be securely fastened on the seat stand 11 without being rotatable.

The front support frame 50 has a front support post 51, a footrest 52, and a front positioning pin 53. A bottom of the front support post 51 is pivotally mounted between bottoms of the pivot wings 122. The front support post 51 is telescopic and can be pivoted so that a bottom portion of the front support post 51 is received within the post holder 123 through the opening. The front support post 51 has a front post positioning hole 511 formed through the front support post 51 and corresponding to the footrest positioning holes 121 of the front support frame seat 12. The footrest 52 is mounted on a top of the front support post 51 and has at least one front shock absorption pad 521 mounted on one side of the footrest 52. The front positioning pin 53 is detachably mounted through the front post positioning hole 511 and the footrest positioning holes 121 to hold the front support frame 50 at position relative to the front support frame seat 12.

The rear support frame 60 has a rear support post 61, a headrest 62, a backrest 63, a waistrest 64, a rear positioning pin 65 and an alignment sector 66. The rear support post 61 is telescopic. A bottom of the rear support post 61 is pivotally between the rear pivot brackets 115 and the pivot elbows 131. The rear support post 61 has a rear post positioning holes 612 formed through the rear support post 61 and corresponding to and aligning with the rear frame positioning holes 132 of the pivot elbows 131. The headrest 62, the backrest 63 and the waistrest 64 are sequentially mounted on the rear support post 61 in a downward direction. The rear positioning pin 65 is detachably mounted through the rear post positioning hole 612 and the rear frame positioning holes 132 of the pivot elbows 131 to hold the rear support post 61 at position relative to the rear support seat 13. The rear support post 61 is pivotable with respect to the rear support seat 13 after the rear positioning pin 65 is removed from the rear post positioning hole 612. The rear support post 61 further has a rear shock absorption pad 611 mounted on a side of the rear support post 61 opposite to the backrest 63. The alignment sector 66 is formed on and protrudes forwardly from a bottom portion of a periphery of the rear support post 61, is mounted between the back alignment plates 113 of the seat stand 11 and has multiple alignment holes 661 formed through the alignment sector 66 and spaced apart from each other. When the rear support frame 60 is pivoted relative to the rear pivot brackets 115, the alignment sector 66 is moved within the two back alignment plates 113. The rear positioning pin 65 can be mounted through the back positioning holes 114 of the back alignment plates 113 and one of the alignment holes 661 of the alignment sector 66 so that the rear support frame 60 is mounted on the seat stand 11 at an angle relative to the seat stand 11.

The multifunctional linked fitness equipment can be operated in several ways as follows.

Figure 4:
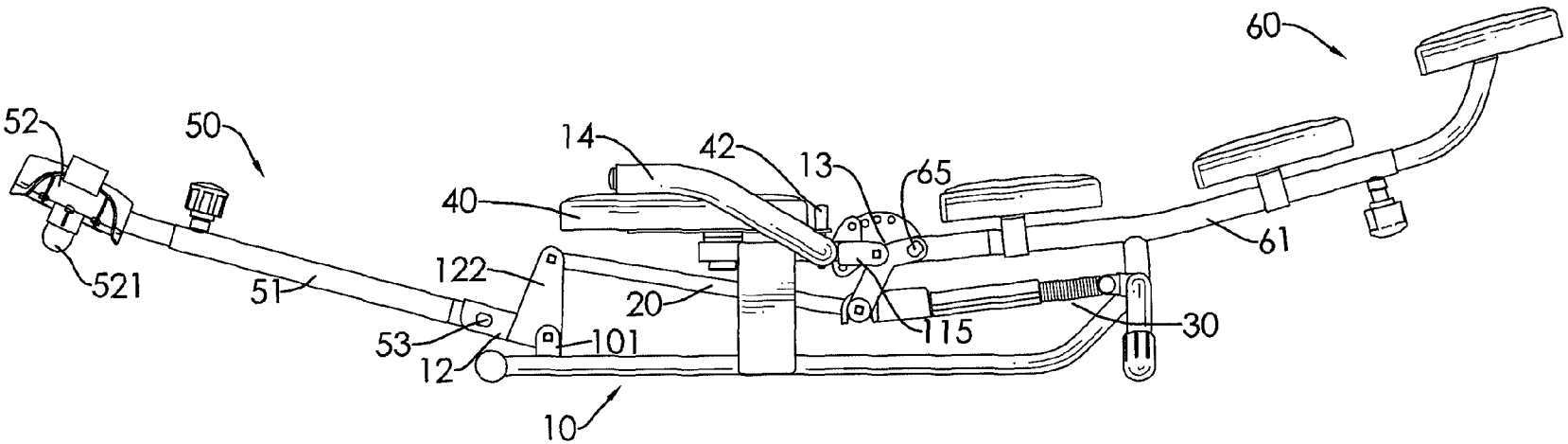
FIG. 4 is a first operational side view of the multi-functional linked fitness equipment in FIG. 1.

With reference to FIG. 4, the front positioning pin 53 is mounted through the front post positioning hole 511 of the front support post 51 and the footrest positioning holes 121 of the front support frame seat 12, the rear positioning pin 65 is mounted through the rear post positioning hole 612 of the rear support post 61 and the rear frame positioning hole 132 of the rear support frame seat 13, and the seat positioning pin 42 is mounted through the seat positioning hole 401 of the seat 40 and the seat locking hole 112 of the seat stand 11. A user can sit on the seat 40 with the legs resting on the footrest 52 of the front support frame 50, the upper body leaning on the rear support frame 60 and both hands holding the handles 14. The front support frame 50 and the rear support frame 60 are respectively pushed by the upper body and the legs, and the front support frame 50 and the rear support frame 60 are oppositely pivoted until the front support frame 50 and the rear support frame 60 align horizontally. Meanwhile, the front support frame seat 12 and the rear support frame seat 13 pivotally connected to the link 20 are also driven so that the at least one resilient member 30 connected to the front support frame seat 12 and the rear support frame seat 13 is extended. When the user stop pressing the front support frame 50 and the rear support frame 60, the restoring elastic force of the at least one resilient member 30 pulls the link 20 to pivot the rear support frame 60 and the front support frame 50 upwardly so as to lift up the upper body and the legs to their original positions. Such operation aims to exercise the upper abdomen, the lower abdomen and the legs of a user.

Figure 5:
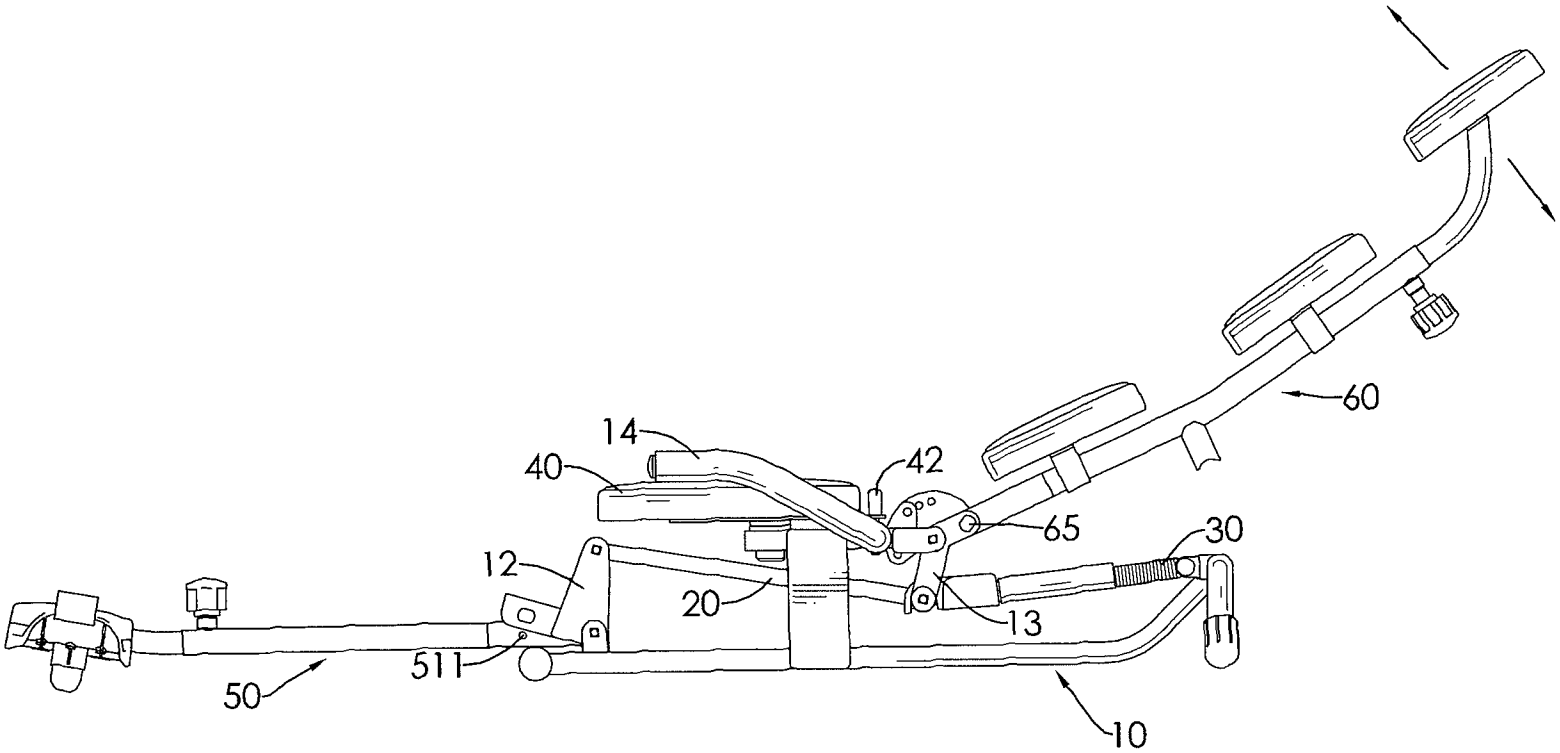
FIG. 5 is a second operational side view of the multi-functional linked fitness equipment in FIG. 1.

With reference to FIG. 5, the front positioning pin 53 mounted through the front post positioning hole 511 of the front support post 51 and the footrest positioning holes 121 of the front support frame seat 12 is removed and the front support frame 50 lies on the floor. A user can sit on the seat 40 with the hands holding the handles 14, the legs stepping on the floor and the upper body pressing down the rear support frame 60 so that the rear support frame 60 can be pressed down to align horizontally. When the rear support frame 60 is pressed down, the link 20 is driven to pivot the front support frame seat 12 and the rear support frame seat 13 so that the at least one resilient member 30 is extended. Such operation aims to exercise the upper abdomen of a user.

Figure 6:
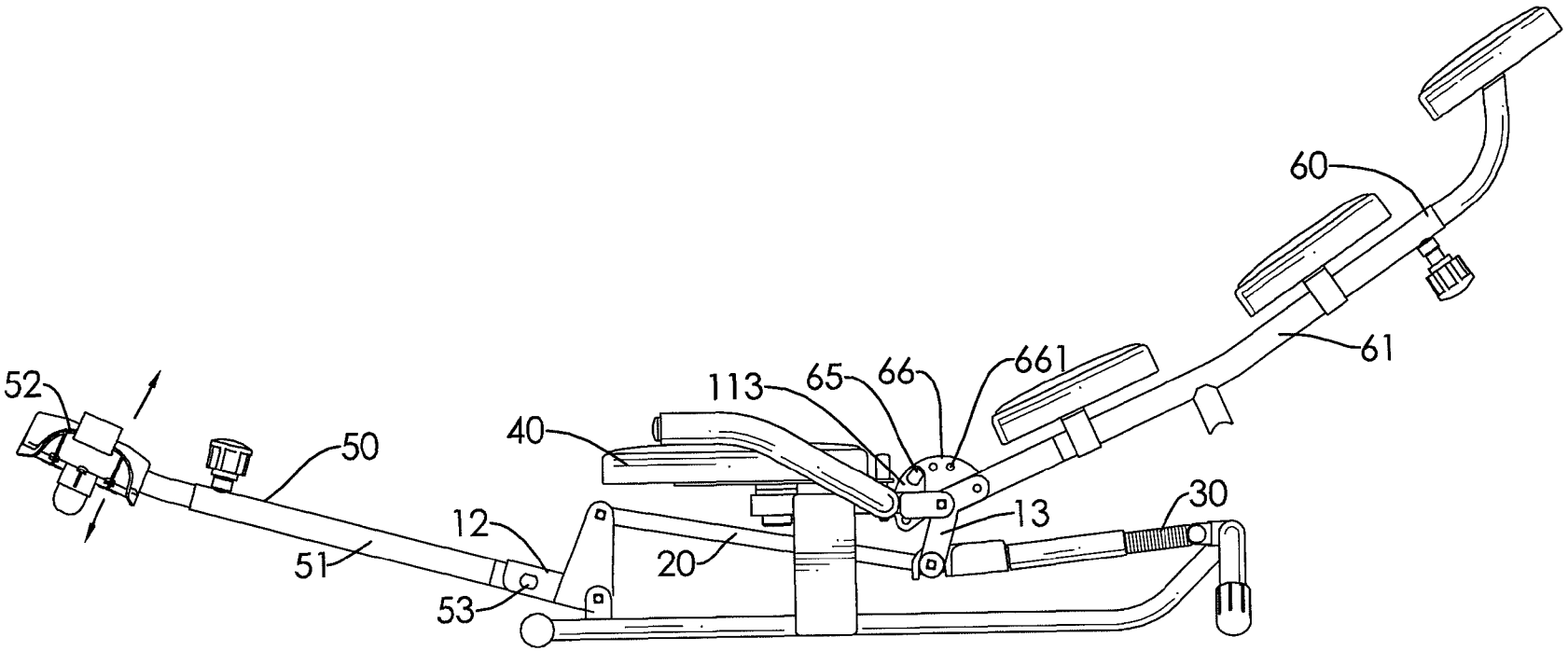
FIG. 6 is a third operational side view of the multi-functional linked fitness equipment in FIG. 1.

With reference to FIG. 6, the front positioning pin 53 is mounted through the front support frame seat 12 and the front support post 51, and the rear positioning pin 65 mounted through the rear support post 61 and the rear support frame seat 13 is removed and is mounted through the back positioning holes 114 of the back alignment plates 113 and one of the alignment holes 661 of the alignment sector 66 so that the rear support frame 60 is not driven by the rear support frame seat 13. A user can adjust an inclined angle of the rear support frame 60 based on personal demand and sit on the seat 40 with the upper body lying on the rear support frame 60, the hands holding the handles 14 and the legs stepping on the footrest 52 of the front support frame 50. The front support frame 50 is pressed down by the legs, and the front support frame 50 drives the front support frame seat 12, the rear support frame seat 13 and the link 20 and simultaneously pulls the at least one resilient member 30. Such operation aims to exercise the lower abdomen and the legs of a user.

Figure 7:
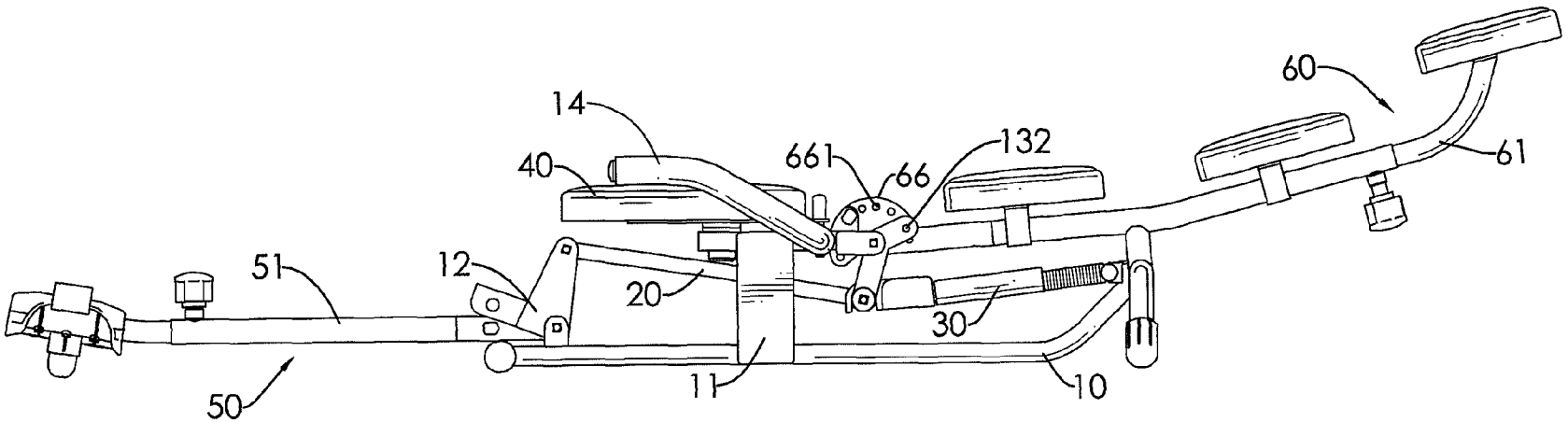
FIG. 7 is another side view of the multi-functional linked fitness equipment in FIG. 1.
Figure 8:
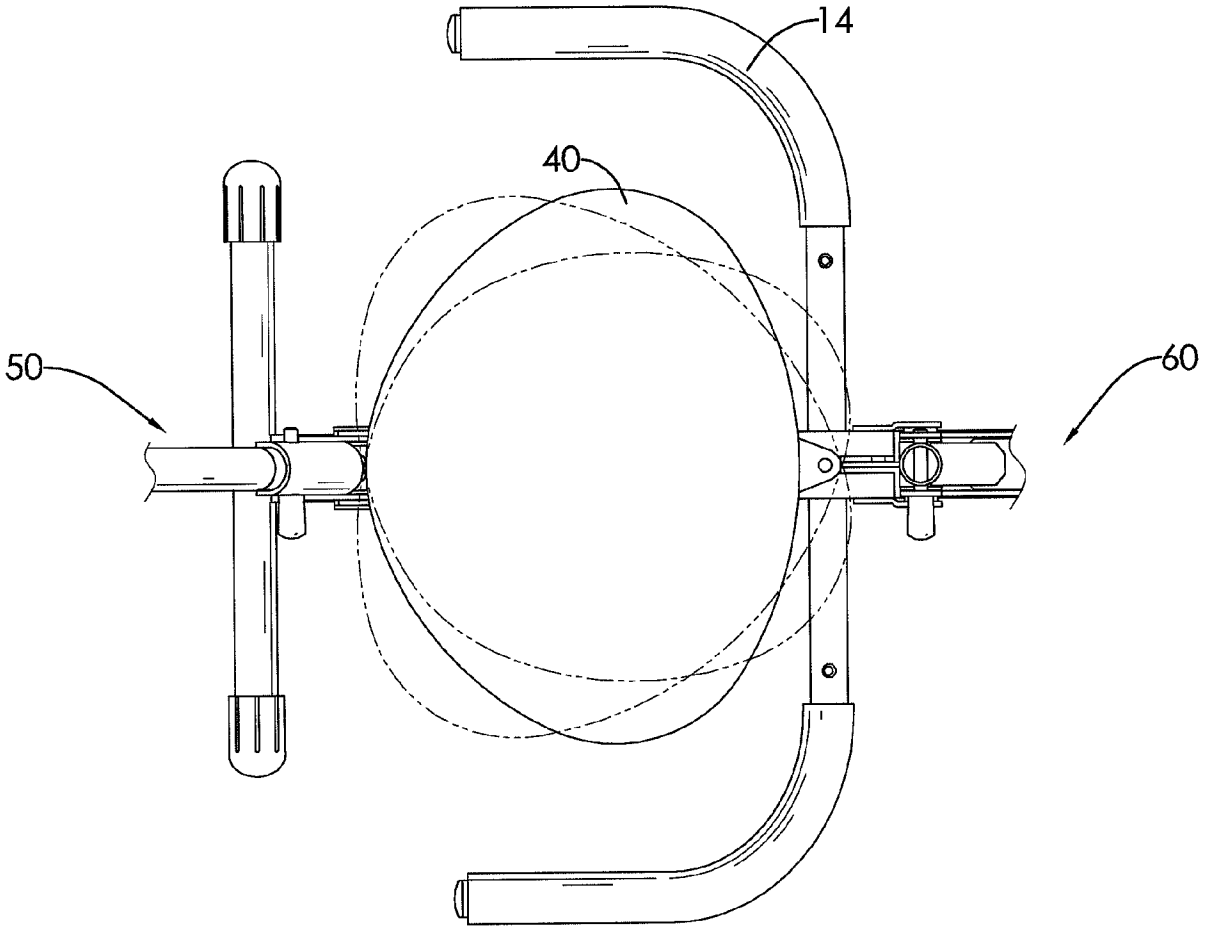
FIG. 8 is an operational top view of the multi-functional linked fitness equipment in FIG. 1.

With reference to FIG. 7, the seat positioning pin 42 is removed from the seat positioning hole 401 of the seat 40 and the seat locking hole 112 of the seat stand 11, the seat 40 can be rotatable relative to the rotary joint 111 of the seat stand 11, and the front support frame 50 lies on the floor and the rear support frame 60 aligns horizontally. With reference to FIG. 8, a user can sit on the seat 40 and rotate the seat 40 with respect to the seat stand 11 so as to twist the waist and swing the hip. Such operation aims to exercise the side the abdominal muscle of a user.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A multifunctional linked fitness equipment comprising:

a base having:

an elongated bottom adapted to rest on a floor and having a front end and a rear end;

a seat stand mounted on the elongated bottom and having:

a front;

a rear;

a seat locking hole formed through the seat stand;

two back alignment plates mounted on the rear of the seat stand; and two back positioning holes respectively formed through the back alignment plates;

a front support frame seat pivotally mounted on the front of the seat stand and having two pivot wings, a bottom end and a positioning hole formed through the front support frame seat, wherein one end of each pivot wing is pivotally mounted on the front end of the elongated bottom; and a rear support frame seat pivotally mounted on the rear of the seat stand, and having a positioning hole formed through the rear support frame seat and a bottom end;

a link having:

a front end pivotally mounted between the free ends of the two pivot wings; and a rear end pivotally mounted on the rear of the seat stand;

at least one resilient member, wherein one end of each one of the at least one resilient member is securely connected with the rear end of the elongated bottom, and the other end is pivotally mounted on the rear end of the link;

a seat mounted on the seat stand and having:

a seat positioning hole formed in a side of the seat facing the seat stand and corresponding to the seat locking hole on the seat stand; and a seat positioning pin detachably mounted through the seat positioning hole and the seat locking hole;

a front support frame pivotally mounted on the front support frame seat and having:

a post positioning hole formed through the front support frame and corresponding to the positioning hole of the front support frame seat; and a front positioning pin detachably mounted through the positioning hole of the front support frame and the positioning hole of the front support frame seat; and a rear support frame pivotally mounted on the rear support frame seat of the seat stand and having:

a bottom;

an alignment sector formed on the bottom of the rear support frame and having multiple alignment holes formed through the alignment sector and spaced apart from each other;

a positioning hole formed through the rear support frame and corresponding to the positioning hole of the rear support frame seat; and a rear positioning pin detachably mounted through the positioning hole of the rear support frame, the positioning hole of the rear support frame seat, and one of the alignment holes of the alignment sector.

2. The multifunctional linked fitness equipment as claimed in claim 1, wherein the seat further has:

a rotation shaft formed on and protrudes downwardly from the bottom of the seat; and a positioning plate mounted on a bottom of the seat, protruding beyond the seat, and having a seat positioning hole formed through a portion of the positioning plate, separated from the rotation shaft, and corresponding to the seat locking hole on the seat stand; and the seat stand further has a rotary joint formed in the seat stand;

wherein the rotation shaft is pivotally mounted through the rotary joint.

3. The multifunctional linked fitness equipment as claimed in claim 2 further comprising two handles, wherein one end of each handle is securely mounted on one side of the seat stand.

4. The multifunctional linked fitness equipment as claimed in claim 3, wherein the rear support frame further has:

a rear support post; and a headrest, a backrest and a waistrest sequentially mounted on the rear support post in a downward direction.

5. The multifunctional linked fitness equipment as claimed in claim 4, wherein the front support frame further has:

a front support post, wherein a bottom end of the front support post is pivotally mounted in the front support frame seat; and a footrest mounted on a top end of the front support post.

* * * * *